US008689908B2

(12) United States Patent
Durairajan et al.

(10) Patent No.: US 8,689,908 B2
(45) **Date of Patent: *Apr. 8, 2014**

(54) DRILL BIT HAVING ENHANCED STABILIZATION FEATURES AND METHOD OF USE THEREOF

(75) Inventors: Bala Durairajan, Houston, TX (US); Carl M. Hoffmaster, Houston, TX (US); Rolando Descarpontriez Arteaga, Hassi Messaoud (BO)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,242

(22) Filed: Mar. 5, 2012

(65) Prior Publication Data

US 2012/0186879 A1 Jul. 26, 2012

Related U.S. Application Data

(63) Continuation of application No. 12/330,633, filed on Dec. 9, 2008, now Pat. No. 8,127,863.

(60) Provisional application No. 61/012,593, filed on Dec. 10, 2007.

(51) Int. Cl.
*E21B 10/42* (2006.01)

(52) U.S. Cl.
CPC ..... *E21B 10/42* (2013.01)
USPC ..... 175/421; 175/431; 175/378; 175/400

(58) Field of Classification Search
USPC ..... 175/419, 420, 421, 431, 378, 400, 397
See application file for complete search history.

(56) References Cited

U.S. PATENT DOCUMENTS

| | | | |
|---|---|---|---|
| 1,923,488 | A | 8/1933 | Howard |
| 2,879,037 | A | 3/1959 | Wolfram |
| 4,593,777 | A | 6/1986 | Barr |
| 4,932,484 | A | 6/1990 | Warren |
| 5,025,873 | A | 6/1991 | Cerkovnik |
| 5,103,922 | A | 4/1992 | Jones |

(Continued)

FOREIGN PATENT DOCUMENTS

| | | |
|---|---|---|
| GB | 2294072 | 4/1996 |
| GB | 2328698 | 3/1999 |

(Continued)

OTHER PUBLICATIONS

Klassen, Jay, et al.; Effective, Cost Efficient Drilling of Deeply Buried Reservoirs; Published Dec. 2007 (7 page).

(Continued)

*Primary Examiner* — Cathleen Hutchins

(57) ABSTRACT

A drill bit for drilling a borehole in earthen formations comprising a bit body having a bit axis and a bit face. In addition, the drill bit comprises a primary blade extending radially along the bit face, the primary blade including a cutter-supporting surface that defines a blade profile in rotated profile view extending from the bit axis to an outer radius of the bit body. The blade profile is continuously contoured and includes a plurality of concave regions. Further, the drill bit comprises a plurality of cutter elements mounted to the cutter-supporting surface of the primary blade. Each cutter element on the primary blade has a forward-facing cutting face with a cutting edge adapted to penetrate and shear the earthen formation.

20 Claims, 9 Drawing Sheets

(56) References Cited

U.S. PATENT DOCUMENTS

| | | | |
|---|---|---|---|
| RE34,435 | E | 11/1993 | Warren |
| 5,582,261 | A | 12/1996 | Keith |
| 5,607,025 | A | 3/1997 | Mensa-Wilmot |
| 5,979,577 | A | 11/1999 | Fielder |
| 6,062,325 | A | 5/2000 | Taylor |
| 6,564,886 | B1 | 5/2003 | Mensa-Wilmot |
| 6,834,733 | B1 | 12/2004 | Maouche |
| 2001/0045305 | A1 | 11/2001 | Fielder |
| 2006/0185901 | A1 | 8/2006 | Sinor |
| 2007/0187149 | A1 | 8/2007 | Kristensen |
| 2007/0221416 | A1 | 9/2007 | Hall et al. |

FOREIGN PATENT DOCUMENTS

| | | |
|---|---|---|
| GB | 2330599 | 4/1999 |
| GB | 2376489 | 12/2002 |
| GB | 2386914 | 10/2003 |

OTHER PUBLICATIONS

Bit; sold more than one year before earliest priority; (1 page).

Warren, T. M., and L. A. Sinor; "PDC Bits: What's needed to meet tomorrow's challenge," University of Tulsa Centennial Petroleum Engineering Symposium, Aug. 29-31, 1994, SPE27978.

Response to Combined Search and Examination Report dated May 1, 2009, for Appl. No. 0822482.6 (20 pages).

Search and Examination Report dated Feb. 22, 2010, for Appl. No. 0822482.6 (4 pages).

Response to Combined Search and Examination Report dated Feb. 22, 2010, for Appl. No. 0822482.6 (23 pages).

Examination Report dated May 28, 2010 for Appl. No. GB0822482.6 (2 pages).

Combined Search and Examination Report dated May 1, 2009 for Appl. No. GB0822482.6 (6 pages).

Speed/Reamer® Bi-Center Bit; 2008 (1 page).

DRILL BIT HAVING ENHANCED STABILIZATION FEATURES AND METHOD OF USE THEREOF

CROSS-REFERENCE TO RELATED APPLICATIONS

This application is a continuation of U.S. patent application Ser. No. 12/330,633, filed Dec. 9, 2008, entitled "Drill Bit Having Enhanced Stabilization Features and Method of Use Thereof," which claims benefit of U.S. provisional application Ser. No. 61/012,593 filed Dec. 10, 2007, and entitled "Drill Bit Having Enhanced Stabilization Features," each of which are hereby incorporated by reference in their entirety.

STATEMENT REGARDING FEDERALLY SPONSORED RESEARCH OR DEVELOPMENT

Not applicable.

BACKGROUND

1. Field of the Invention

The invention relates generally to earth-boring drill bits used to drill a borehole for the ultimate recovery of oil, gas, or minerals. More particularly, the invention relates to drag bits with blade profiles providing inherent stability and mechanical lock.

2. Background of the Invention

An earth-boring drill bit is typically mounted on the lower end of a drill string and is rotated by rotating the drill string at the surface or by actuation of downhole motors or turbines, or by both methods.

In drilling a borehole in the earth, such as for the recovery of hydrocarbons or for other applications, it is conventional practice to connect a drill bit on the lower end of an assembly of drill pipe sections which are connected end-to-end so as to form a "drill string." The bit is rotated by rotating the drill string at the surface or by actuation of downhole motors or turbines, or by both methods. With weight applied to the drill string, the rotating drill bit engages the earthen formation causing the bit to cut through the formation material by either abrasion, fracturing, or shearing action, or through a combination of all cutting methods, thereby forming a borehole along a predetermined path toward a target zone. The borehole thus created will have a diameter generally equal to the diameter or "gage" of the drill bit.

While the bit is rotated, drilling fluid is pumped through the drill string and directed out of the drill bit. The fixed cutter bit typically includes nozzles or fixed ports spaced about the bit face that serve to inject drilling fluid into the flow passageways between the several blades. The drilling fluid is provided to cool the bit and to flush cuttings away from the cutting structure of the bit and upwardly into the annulus formed between the drill string and the borehole.

Many different types of drill bits have been developed and found useful in drilling such boreholes. Two predominate types of rock bits are roller cone bits and fixed cutter (or rotary drag) bits. Most fixed cutter bit designs include a plurality of blades angularly spaced about the bit face. The blades project radially outward from the bit body and form flow channels therebetween. In addition, the cutter elements are typically grouped and mounted on several blades in radially extending rows. The configuration or layout of the cutter elements on the blades may vary widely, depending on a number of factors such as the formation to be drilled.

The cutter elements disposed on the several blades of a fixed cutter bit are typically formed of extremely hard materials. In the typical fixed cutter bit, each cutter element comprises an elongate and generally cylindrical tungsten carbide support member which is received and secured in a pocket formed in the surface of one of the several blades. The cutter element typically includes a hard cutting layer of polycrystalline diamond (PD) or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. For convenience, as used herein, reference to "PDC bit" or "PDC cutter element" refers to a fixed cutter bit or cutter element employing a hard cutting layer of polycrystalline diamond or other superabrasive material.

Without regard to the type of bit, the cost of drilling a borehole is proportional to the length of time it takes to drill the borehole to the desired depth and location. The drilling time, in turn, is greatly affected by the number of times the drill bit must be changed, in order to reach the targeted formation. This is the case because each time the bit is changed the entire drill string, which may be miles long, must be retrieved from the borehole section by section. Once the drill string has been retrieved and the new bit installed, the bit must be lowered to the bottom of the borehole on the drill string which again must be constructed section by section. As is thus obvious, this process, known as a "trip" of the drill string, requires considerable time, effort and expense. Accordingly, it is always desirable to employ drill bits which will drill faster and longer and which are usable over a wider range of differing formation hardnesses.

The length of time that a drill bit may be employed before it must be changed depends upon its rate of penetration ("ROP"), as well as its durability or ability to maintain a high or acceptable ROP. Additionally, a desirable characteristic of the bit is that it be "stable" and resist vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes the premature wearing or destruction of the cutting elements and a loss of penetration rate. Thus, preventing bit vibration and maintaining stability of PDC bits has long been a desirable goal, but one which has not always been achieved. Bit vibration typically may occur in any type of formation, but is most detrimental in the harder formations.

In recent years, the PDC bit has become an industry standard for cutting formations of soft and medium hardnesses. However, as PDC bits are being developed for use in harder formations, bit stability is becoming an increasing challenge. As previously described, excessive bit vibration during drilling tends to dull the bit and/or may damage the bit to an extent that a premature trip of the drill string becomes necessary.

There have been a number of alternative designs proposed for PDC cutting structures that were meant to provide a PDC bit capable of drilling through a variety of formation hardnesses at effective ROP's and with acceptable bit life or durability. Unfortunately, many of the bit designs aimed at minimizing vibration require that drilling be conducted with an increased weight-on-bit (WOB) as compared with bits of earlier designs. For example, some bits have been designed with cutters mounted at less aggressive backrake angles such that they require increased WOB in order to penetrate the formation material to the desired extent. Drilling with an increased or heavy WOB has serious consequences and is generally avoided if possible. Increasing the WOB is accomplished by adding additional heavy drill collars to the drill string. This additional weight increases the stress and strain on all drill string components, causes stabilizers to wear more and to work less efficiently, and increases the hydraulic pressure drop in the drill string, requiring the use of higher capacity (and typically higher cost) pumps for circulating the drilling fluid. Compounding the problem still further, the increased WOB causes the bit to wear and become dull much more quickly than would otherwise occur. In order to postpone tripping the drill string, it is common practice to add further WOB and to continue drilling with the partially worn and dull bit. The relationship between bit wear and WOB is not linear, but is an exponential one, such that upon exceeding a particular WOB for a given bit, a very small increase in WOB will cause a tremendous increase in bit wear. Thus, adding more WOB so as to drill with a partially worn bit further escalates the wear on the bit and other drill string components.

Accordingly, there remains a need in the art for a fixed cutter bit capable of drilling effectively at economical ROP's and, ideally, to drill in formations having a hardness greater than that in which conventional PDC bits can be employed. More specifically, there is a need for a PDC bit which can drill in soft, medium, medium hard and even in some hard formations while maintaining an aggressive cutter profile so as to maintain acceptable ROP's for acceptable lengths of time and thereby lower the drilling costs presently experienced in the industry. Such a bit should also provide an increased measure of stability as wear occurs on the cutting structure of the bit so as to resist bit vibration. Ideally, the increased stability of the bit should be achieved without having to employ substantial additional WOB and suffering from the costly consequences which arise from drilling with such extra weight.

BRIEF SUMMARY OF SOME OF THE PREFERRED EMBODIMENTS

These and other needs in the art are addressed in one embodiment by a drill bit for drilling a borehole in earthen formations. In an embodiment, the drill bit comprises a bit body having a bit axis and a bit face. In addition, the drill bit comprises a primary blade extending radially along the bit face, the primary blade including a cutter-supporting surface that defines a blade profile in rotated profile view extending from the bit axis to an outer radius of the bit body. The blade profile is continuously contoured and includes a plurality of concave regions. Further, the drill bit comprises a a plurality of cutter elements mounted to the cutter-supporting surface of the primary blade. Each cutter element on the primary blade has a forward-facing cutting face with a cutting edge adapted to penetrate and shear the earthen formation.

These and other needs in the art are addressed in another embodiment by a drill bit for drilling a borehole in earthen formations. In an embodiment, the drill bit comprises a bit body having a bit axis and a bit face. In addition, the drill bit comprises a plurality of primary blades, each primary blade extending radially along the bit face and including a cutter-supporting surface. Further, the drill bit comprises a plurality of cutter elements mounted to the cutter-supporting surface of each of the primary blades. Each cutter element on the primary blade has a forward-facing cutting face with a cutting edge adapted to penetrate and shear the earthen formation. The cutter-supporting surfaces of the plurality of blades define a continuously contoured composite blade profile in rotated profile view that extends from the bit axis to an outer radius of the bit body. Moreover, the composite blade profile includes a first convex region having a first blade profile nose and a second convex region having a second blade profile nose.

These and other needs in the art are addressed in another embodiment by a method of drilling a borehole in an earthen formation. In an embodiment, the method comprises engaging the formation with a drill bit. The drill bit comprises a bit body having a bit axis and a bit face. In addition, the drill bit comprises a plurality of primary blades, each primary blade extending radially along the bit face and including a cutter-supporting surface. Further, the drill bit comprises a plurality of cutter elements mounted to the cutter-supporting surface of each of the primary blades. Each cutter element on the primary blade has a forward-facing cutting face with a cutting edge adapted to penetrate and shear the earthen formation. The cutter-supporting surfaces of the plurality of blades define a wave-shaped continuously contoured composite blade profile in rotated profile view extending between the bit axis and an outer radius of the bit body. Moreover, the composite blade profile includes a first concave region radially spaced from the bit axis. Still further, the method comprises forming a ring-shaped bolus of uncut formation that extends axially into the at least one concave region.

Thus, embodiments described herein comprise a combination of features and advantages intended to address various shortcomings associated with certain prior drill bits and methods of using the same. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

For a more detailed description of the preferred embodiments, reference will now be made to the accompanying drawings, wherein.

DETAILED DESCRIPTION OF SOME OF THE PREFERRED EMBODIMENTS

Figure 1:
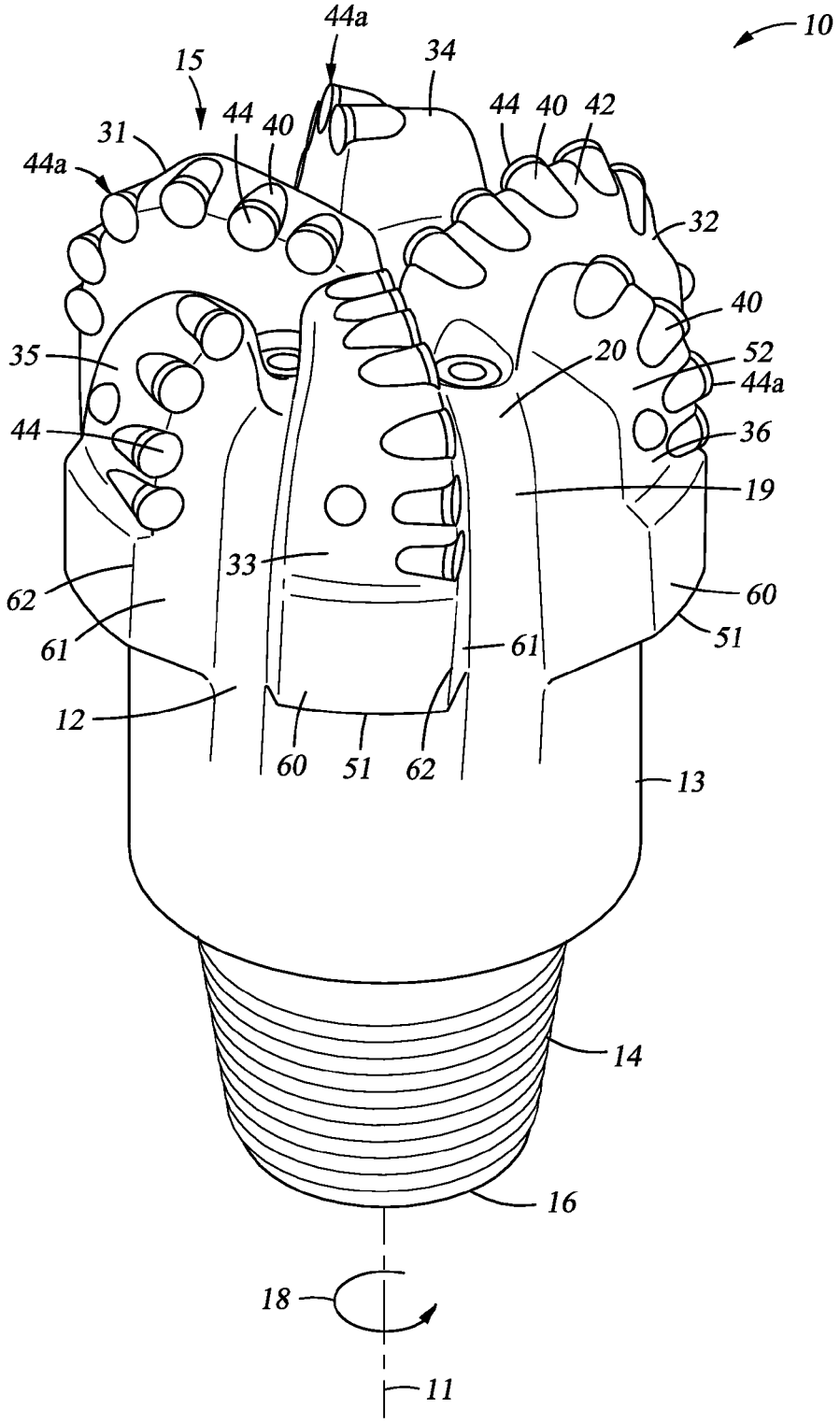
Fig. 1 (PRIOR ART)
FIG. 1 is a perspective view of a conventional fixed cutter bit.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Figure 2:
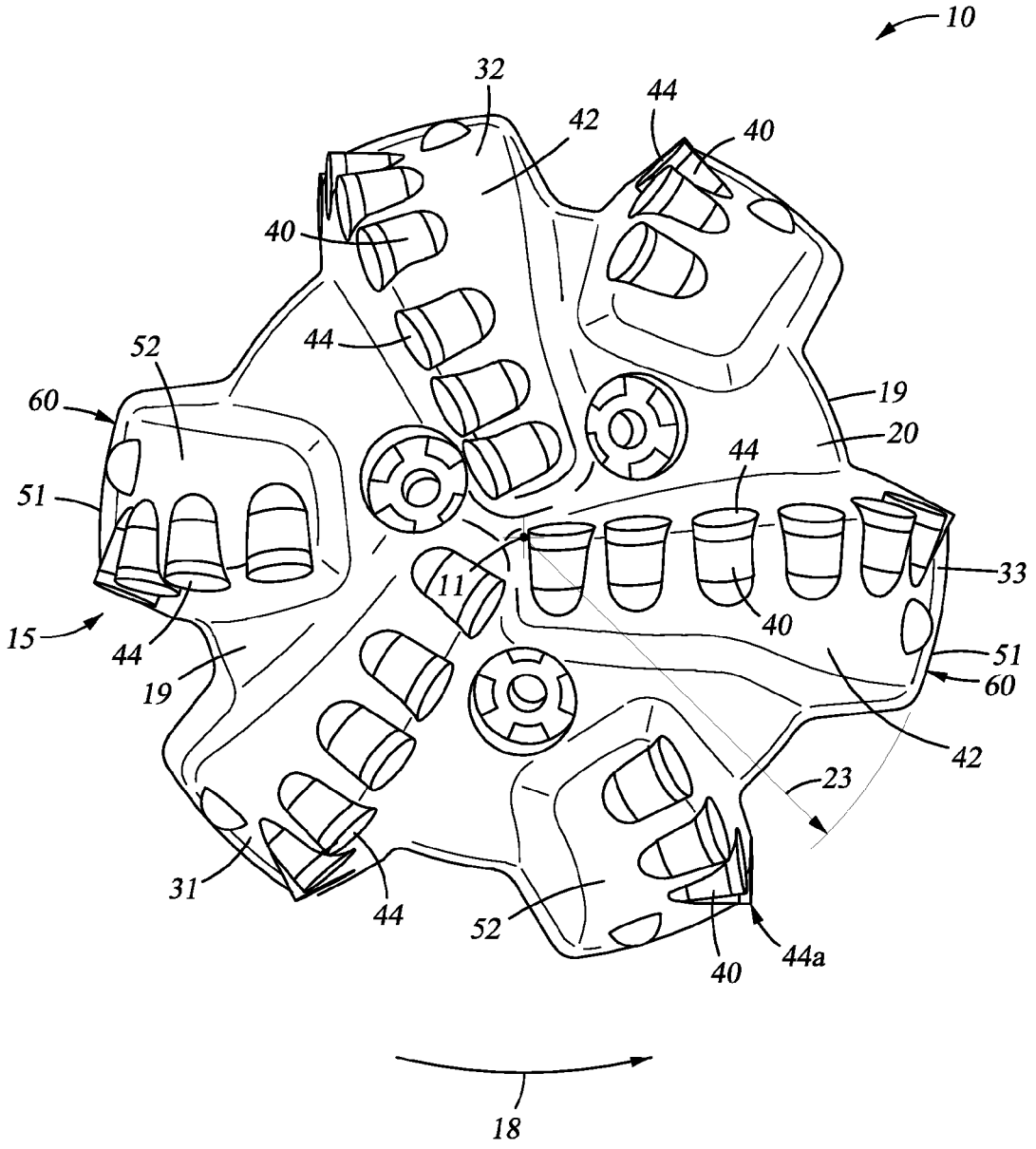
Fig. 2 (PRIOR ART)
FIG. 2 is a top view of the bit shown in FIG. 1.

Referring to FIGS. 1 and 2, a conventional fixed cutter or drag bit 10 adapted for drilling through formations of rock to form a borehole is shown. Bit 10 generally includes a bit body 12, a shank 13 and a threaded connection or pin 14 for connecting bit 10 to a drill string (not shown), which is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18.

Cutting structure 15 is provided on face 20 of bit 10. Cutting structure 15 includes a plurality of angularly spaced-apart primary blades 31, 32, 33 and secondary blades 34, 35, 36, each of which extends from bit face 20. Primary blades 31, 32, 33 and secondary blades 34, 35, 36 extend generally radially along bit face 20 and then axially along a portion of the periphery of bit 10. However, secondary blades 34, 35, 36 extend radially along bit face 20 from a location that is distal bit axis 11 toward the periphery of bit 10. Thus, as used herein, the term "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes a cutter-supporting surface 42 for mounting a plurality of cutter elements, and each secondary blade 34, 35, 36 includes a cutter-supporting surface 52 for mounting a plurality of cutter elements. In particular, cutter elements 40, each having a cutting face 44, are mounted to cutter-supporting surfaces 42, 52 of each primary blade 31, 32, 33 and each secondary blade 34, 35, 36, respectively. Cutter elements 40 are arranged adjacent one another in a radially extending row proximal the leading edge of each primary blade 31, 32, 33 and each secondary blade 34, 35, 36. Each cutting face 44 has an outermost cutting tip 44*a* furthest from cutter-supporting surface 42, 52 to which it is mounted.

Figure 3:
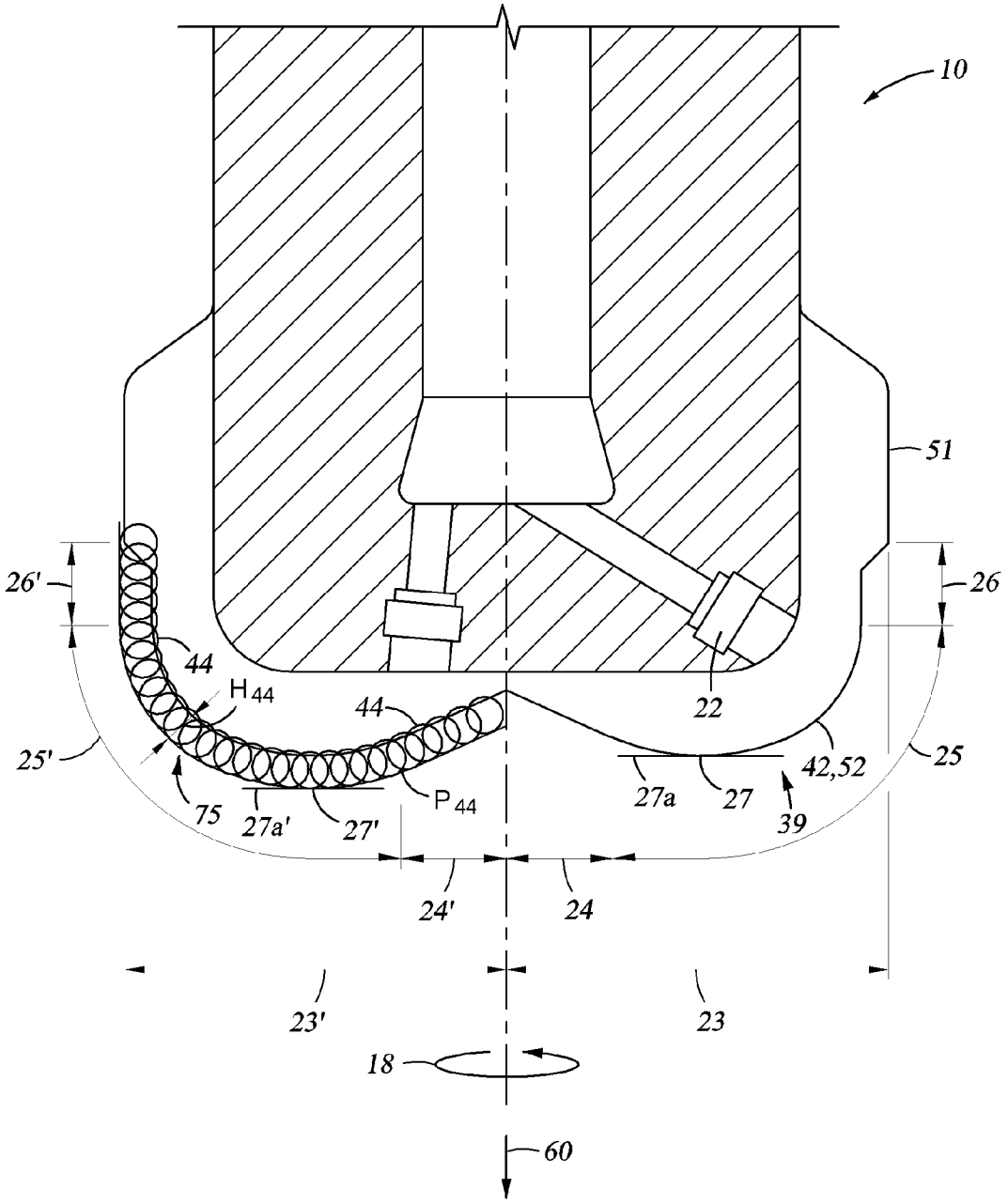
Fig. 3 (PRIOR ART)
FIG. 3 is a partial cross-sectional view of the bit shown in FIG. 1 with the blades and the cutting faces of the cutter elements rotated into a single composite profile.

Referring now to FIG. 3, an exemplary profile of bit 10 is shown as it would appear with all blades (e.g., primary blades 31, 32, 33 and secondary blades 34, 35, 36) and cutting faces 44 of all cutter elements 40 rotated into a single rotated profile. In rotated profile view, cutter-supporting surfaces 42, 52 of all blades 31-36 of bit 10 form and define a combined or composite blade profile 39 that extends radially from bit axis 11 to outer radius 23 of bit 10. Thus, as used herein, the phrase "composite blade profile" refers to the profile, extending from the bit axis to the outer radius of the bit, formed by the cutter-supporting surfaces of all the blades of a bit rotated into a single rotated profile (i.e., in rotated profile view).

Conventional composite blade profile 39 (most clearly shown in the right half of bit 10 in FIG. 3) may generally be divided into three regions conventionally labeled cone region 24, shoulder region 25, and gage region 26. Cone region 24 comprises the radially innermost region of bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional bit 10 includes one concave region—cone region 24, and one convex region—shoulder region 25.

Figure 4:
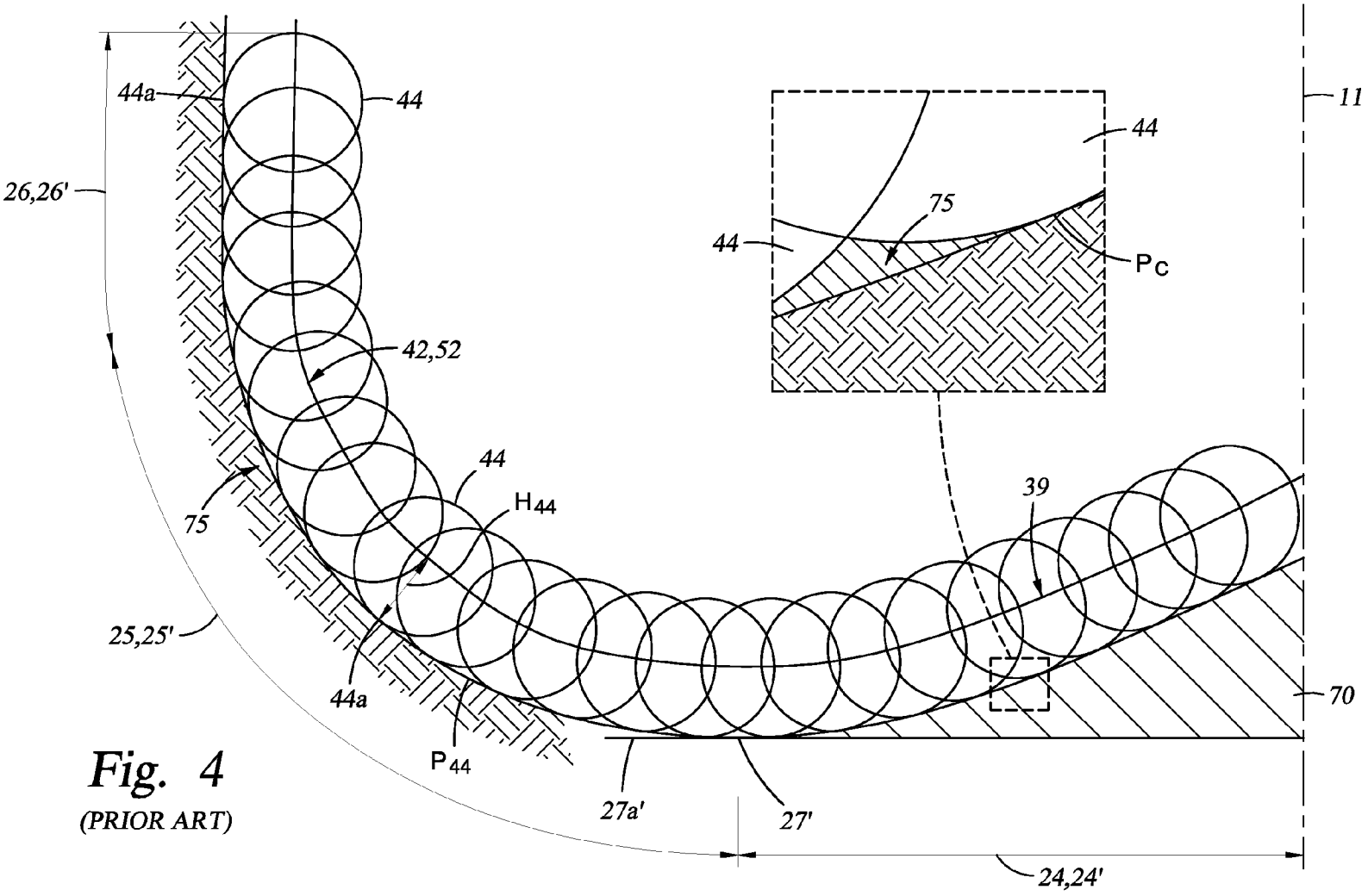
Fig. 4 (PRIOR ART)
FIG. 4 is an enlarged partial cross-sectional view of the bit shown in FIG. 3.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. As best shown in FIGS. 3 and 4, for most conventional fixed cutter bits (e.g., bit 10), the composite blade profile includes only one convex shoulder region (e.g., convex shoulder region 25), and only one blade profile nose (e.g., nose 27).

As shown in FIGS. 1-3, cutter elements 40 are arranged in rows along blades 31-36 and are positioned along the bit face 20 in the regions previously described as cone region 24, shoulder region 25 and gage region 26 of composite blade profile 39. In particular, cutter elements 40 are mounted on blades 31-36 in predetermined radially-spaced positions relative to the central axis 11 of the bit 10.

Referring still to FIG. 3, each cutting face 44 extends to an extension height $H_{44}$ measured perpendicularly from cutter-supporting surface 42, 52 (or blade profile 39) to its outermost cutting tip 44*a*. As used herein, the phrase "extension height" is used to describe the distance or height to which a structure (e.g., cutting face, depth-of-cut limiter, etc.) extends perpendicularly from the cutter-supporting surface (e.g., cutter-supporting surface 42, 52) of the blade to which it is attached. In rotated profile view, the outermost cutting tips 44*a* of cutting faces 44 form and define an outermost composite outermost cutting profile $P_{44}$ that extends radially from bit axis 11 to outer radius 23. In FIG. 3, outermost composite cutting profile $P_{44}$ of bit 10 is best seen on the left half of the rotated profile. In particular, a curve passing through each outermost cutting tips 44*a* that is not eclipsed or covered by another cutting face 44 represents outermost composite cutting profile $P_{44}$.

Figure 5:
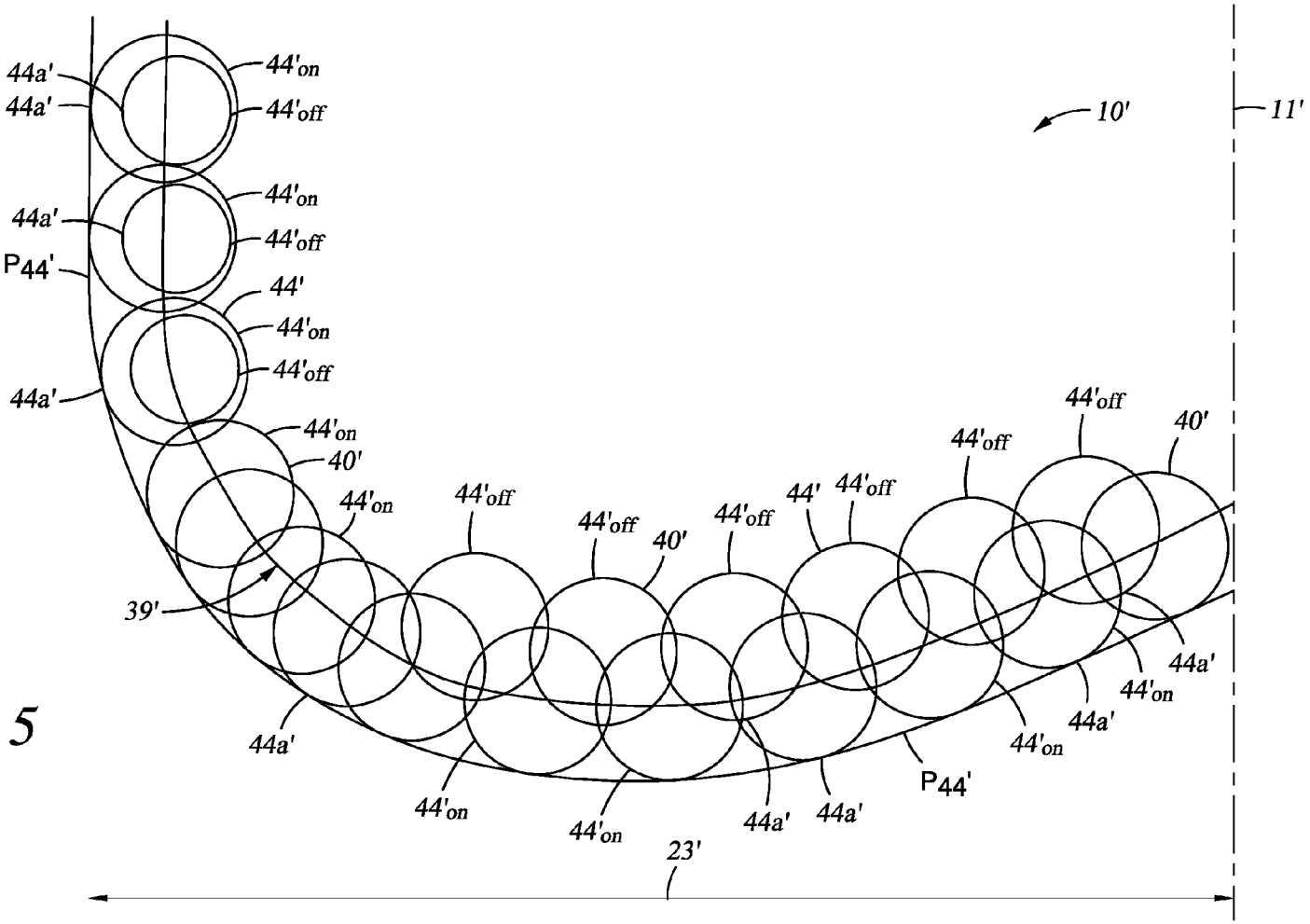
FIG. 5 is an enlarged partial cross-sectional view of an exemplary bit with the blades and the cutting faces of the cutter elements rotated into a single composite profile.

As shown in FIG. 3, each cutting face 44 has substantially the same extension height $H_{44}$, and no cutting tips 44*a* are eclipsed or covered by another cutting face 44. However, in other bits, the cutting tips of one or more select cutter elements may be eclipsed or covered by another cutting face in rotated profile view. Such cutting tips that are eclipsed or covered by the cutting faces of other cutter elements in rotated profile view do not extend to, and hence, do not define the outermost composite cutting profile. For example, referring briefly to FIG. 5, an exemplary profile of a bit 10' is shown as it would appear with all blades and cutting faces 44' of all cutter elements 40' rotated into a single rotated profile. In rotated profile view, the cutter-supporting surfaces of all the blades of bit 10' form and define a combined or composite blade profile 39' that extends radially from bit axis 11' to outer radius 23' of bit 10'. Further, in rotated profile view, cutting faces 44' define an outermost cutting profile $P_{44'}$. However, as shown in FIG. 5, not every cutting face 44' and associated cutting tip 44*a'* is included in the outermost cutting profile $P_{44'}$. In particular, cutting faces 44' extending to and define outermost cutting profile $P_{44}$, labeled 44', include cutting tips 44*a'* that are not eclipsed or covered by another cutting face 44'. However, cutting faces 44' that do not extend to and define outermost cutting profile $P_{44'}$, labeled $\mathbf{44'}_{off}$, include cutting tips 44*a'* that are eclipsed or covered by another cutting face 44'. Only cutting tips 44*a'* of those cutting faces $\mathbf{44'}_{on}$ that are not eclipsed or covered by another cutting face 44' define the define outermost cutting profile $P_{44'}$. Thus, as used herein, the phrase "outermost composite cutting profile" refers to the curve or profile defined by the outermost cutting tips of the cutting faces of the drill bit which extend to and contact the formation in rotated profile view, and extends from the bit axis to the outer radius of the bit. The "outermost composite cutting profile" does not include or pass through the cutting tips that are covered by the cutting face of another cutter element in rotated profile view. The outermost composite cutting profile extends radially from the bit axis to full gage diameter.

Referring now to FIGS. 3 and 4, similar to composite blade profile 39, conventional outermost composite cutting profile $P_{44}$ may also be divided into three regions labeled cone region 24', shoulder region 25', and gage region 26'. Cone region 24' comprises the radially innermost region of bit 10 and outermost composite cutting profile $P_{44}$ extending generally from bit axis 11 to shoulder region 25'. Moving radially outward, adjacent shoulder region 25' is the gage region 26' which extends parallel to bit axis 11 at the outer radial periphery of outermost composite cutting profile $P_{44}$. Analogous to regions 24, 25 of composite blade profile 39, in most conventional fixed cutter bits (e.g., bit 10), cone region 24' and shoulder region 25' of outermost cutting profile $P_{44}$ are generally concave and convex, respectively.

The axially lowermost point of convex shoulder region 25' and composite cutting profile $P_{44}$ defines a cutting profile nose 27'. At cutting profile nose 27', the slope of a tangent line 27*a'* to convex shoulder region 25' and outermost composite cutting profile $P_{44}$ is zero. Thus, as used herein, the term "cutting profile nose" refers to the point along a convex region of an outermost composite cutting profile of a bit in rotated profile view at which the slope of a tangent to the outermost composite cutting profile is zero. As best shown in FIGS. 3 and 4, for most conventional fixed cutter bits (e.g., bit 10), the outermost composite cutting profile includes only one convex shoulder region (e.g., convex shoulder region 25'), and only one cutting profile nose (e.g., nose 27').

Gage pads 51 extend from each blade and define the outer radius 23 and the full gage diameter of bit 10. As used herein, the term "full gage diameter" is used to describe elements or surfaces extending to the full, nominal gage of the bit diameter.

Referring now to FIG. 4, an enlarged rotated profile view of bit 10 engaging an earthen formation is schematically shown. Cutter elements 40 mounted to blades 31-36 are sized and radially spaced such that adjacent cutting faces 44 partially overlap in rotated profile view, thereby forming a ridge or kerf 75 of uncut formation between adjacent cutting faces 44 as bit 10 is rotated. On a micro-level, ridges 75 of uncut formation between adjacent cutting faces 44 in rotated profile view restrict the lateral and radial movement of bit 10 in a direction generally perpendicular to bit axis 11, thereby tending to enhance the stability of bit 10. Moreover, the generally concave shape of composite blade profile 39 and outermost composite cutting profile $P_{44}$ in cone regions 24, 24', respectively, results in a central peak or core 70 of uncut formation that extends axially into concave cone regions 24, 24'. On a macro-level, core 70 of uncut formation restricts the lateral and radial movement of bit 10 in a direction generally perpendicular to bit axis 11, thereby tending to enhance the stability of bit 10.

Figure 6:
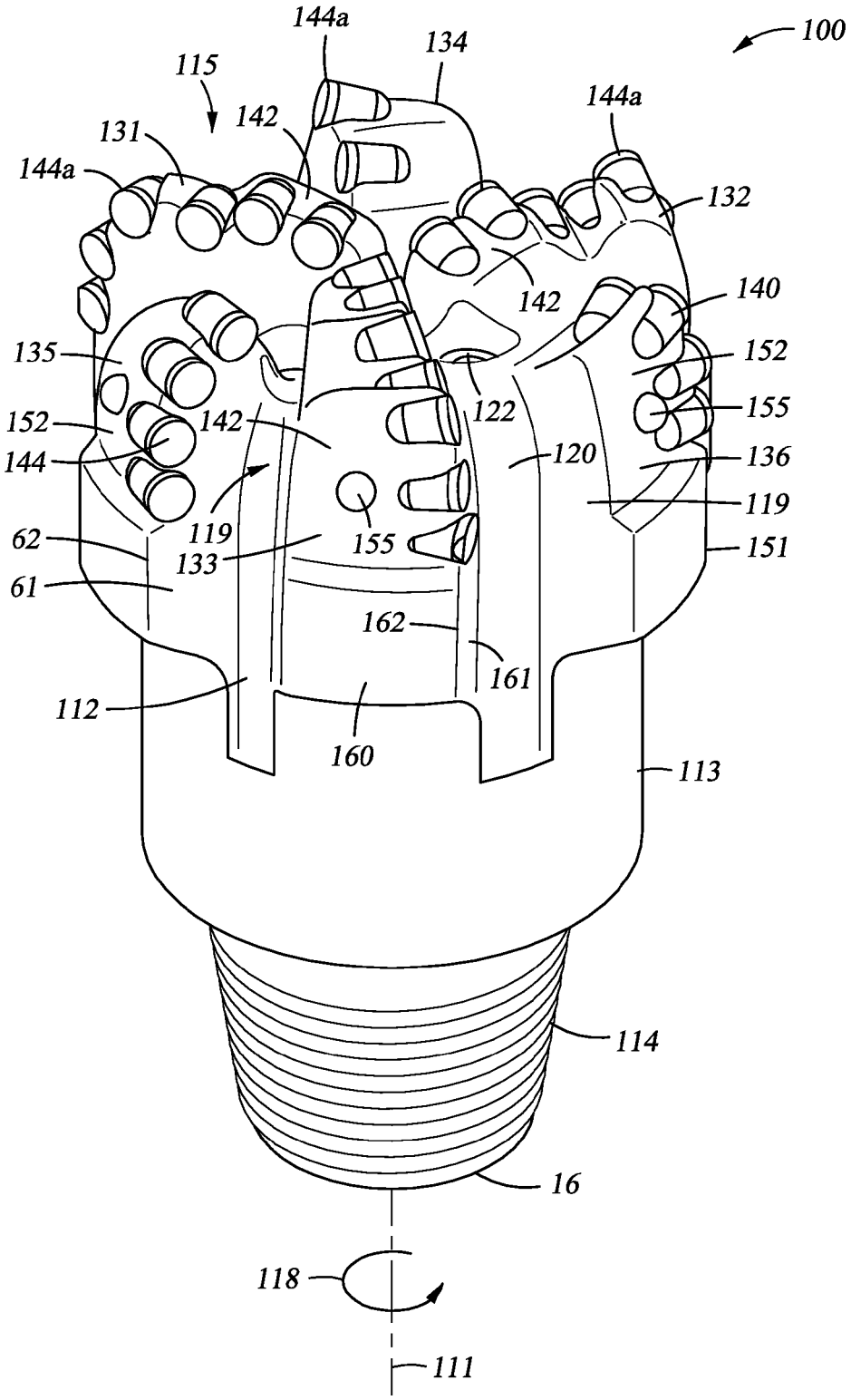
FIG. 6 is a perspective view of an embodiment of a fixed cutter bit in accordance with the principles described herein.

Referring now to FIG. 6, an embodiment of a fixed cutter or drag bit 100 in accordance with the principles described herein is shown. Bit 100 is a fixed cutter or drag bit, and is preferably a PD bit adapted for drilling through formations of rock to form a borehole. Bit 100 generally includes a bit body 112, a shank 113 and a threaded connection or pin 114 for connecting bit 100 to a drill string (not shown), which is employed to rotate the bit in order to drill the borehole. Bit face 120 supports a cutting structure 115 and is formed on the end of the bit 100 that is opposite pin end 116. Bit 100 further includes a central axis 111 about which bit 100 rotates in the cutting direction represented by arrow 118. As used herein, the terms "axial" and "axially" generally mean along or parallel to the bit axis (e.g., bit axis 111), while the terms "radial" and "radially" generally mean perpendicular to the bit axis. Body 112 may be formed in a conventional manner using powdered metal tungsten carbide particles in a binder material to form a hard metal cast matrix. Alternatively, the body can be machined from a metal block, such as steel, rather than being formed from a matrix.

Cutting structure 115 includes a plurality of blades which extend from bit face 120. In this embodiment, cutting structure 115 includes three angularly spaced-apart primary blades 131, 132, 133, and three angularly spaced apart secondary blades 134, 135, 136 generally arranged in an alternating fashion about the circumference of bit 100. Primary blades 131, 132, 133 and secondary blades 134, 135, 136 are integrally formed as part of, and extend from, bit body 112 and bit face 120. Primary blades 131, 132, 133 and secondary blades 134, 135, 136 extend generally radially along bit face 120 and then axially along a portion of the periphery of bit 100. In particular, primary blades 131, 132, 133 extend radially central axis 111 toward the periphery of bit 100. Thus, as used herein, the term "primary blade" may be used to refer to a blade begins proximal the bit axis and extends generally radially along the bit face to the periphery of the bit. However, secondary blades 134, 135, 136 extend radially along bit face 120 from a location that is distal bit axis 111 toward the periphery of bit 100. Thus, as used herein, the term "secondary blade" may be used to refer to a blade that begins at some distance from the bit axis and extends generally radially along the bit face to the periphery of the bit. Primary blades 131, 132, 133 and secondary blades 134, 135, 136 are separated by drilling fluid flow courses 119.

Referring still to FIG. 6, each primary blade 131, 132, 133 includes a cutter-supporting surface 142 for mounting a plurality of cutter elements, and each secondary blade 134, 135, 136 includes a cutter-supporting surface 152 for mounting a plurality of cutter elements. The cutter-supporting surfaces 142, 152 of the primary blades and secondary blades also include a depth-of-cut limiter 155. Cutter elements 140, each having a cutting face 144, are mounted to cutter-supporting surfaces 142, 152 of each primary blade 131, 132, 133 and each secondary blade 134, 135, 136, respectively. In this embodiment, a plurality of cutter elements 140 are arranged in a radially extending row on each primary blade 131, 132, 133 and each secondary blade 134, 135, 136. In general, any suitable number of cutter elements (e.g., cutter elements 140) may be provided on each primary blade (e.g., primary blades 131, 132, 133) and each secondary blade (e.g., secondary blades 134, 135, 136). As one skilled in the art will appreciate, variations in the number, size, orientation, and locations of the blades (e.g., primary blades, 131, 132, 133, secondary blades 134, 135, 136, etc.), and the cutter elements (e.g., cutter elements 140) are possible.

Each primary cutter element 140 comprises an elongated and generally cylindrical support member or substrate which is received and secured in a pocket formed in the surface of the blade to which it is fixed. In general, each cutter element may have any suitable size and geometry. In this embodiment, each cutter element 140 has substantially the same size and geometry. However, in other embodiments, one or more cutter elements (e.g., cutter elements 140) may have a different size and/or geometry.

Each cutting face 144 has an outermost cutting tip 144*a* furthest from cutter-supporting surface 142, 152 to which it is mounted. In addition, cutting face 144 of each cutter element 140 comprises a disk or tablet-shaped, hard cutting layer of polycrystalline diamond or other superabrasive material is bonded to the exposed end of the support member. In the embodiments described herein, each cutter element 140 is mounted such that its cutting faces 144 is generally forward-facing. As used herein, "forward-facing" is used to describe the orientation of a surface that is substantially perpendicular to, or at an acute angle relative to, the cutting direction of the bit (e.g., cutting direction 118 of bit 100). For instance, a forward-facing cutting face (e.g., cutting face 144) may be oriented perpendicular to the cutting direction of the bit, may include a backrake angle, and/or may include a siderake angle. However, the cutting faces are preferably oriented perpendicular to the direction of rotation of the bit plus or minus a 45° backrake angle and plus or minus a 45° siderake angle. In addition, each cutting face 144 includes a cutting edge adapted to positively engage, penetrate, and remove formation material with a shearing action, as opposed to the grinding action utilized by impregnated bits to remove formation material. Such cutting edge may be chamfered or beveled as desired. In this embodiment, cutting faces 144 are substantially planar, but may be convex or concave in other embodiments.

Bit 100 further includes gage pads 151 of substantially equal axial length in this embodiment. Gage pads 151 are disposed about the circumference of bit 100 at angularly spaced locations. Specifically, a gage pad 151 intersects and extend from each blade. Gage pads 151 are integrally formed as part of the bit body 112. Gage pads 151 can help maintain the size of the borehole by a rubbing action when primary cutter elements 140 wear slightly under gage. The gage pads also help stabilize the bit against vibration. In other embodiments, one or more of the gage pads (e.g., gage pads 151) may include other structural features. For instance, wear-resistant cutter elements or inserts may be embedded in gage pads and protrude from the gage-facing surface or forward-facing surface.

Figure 7:
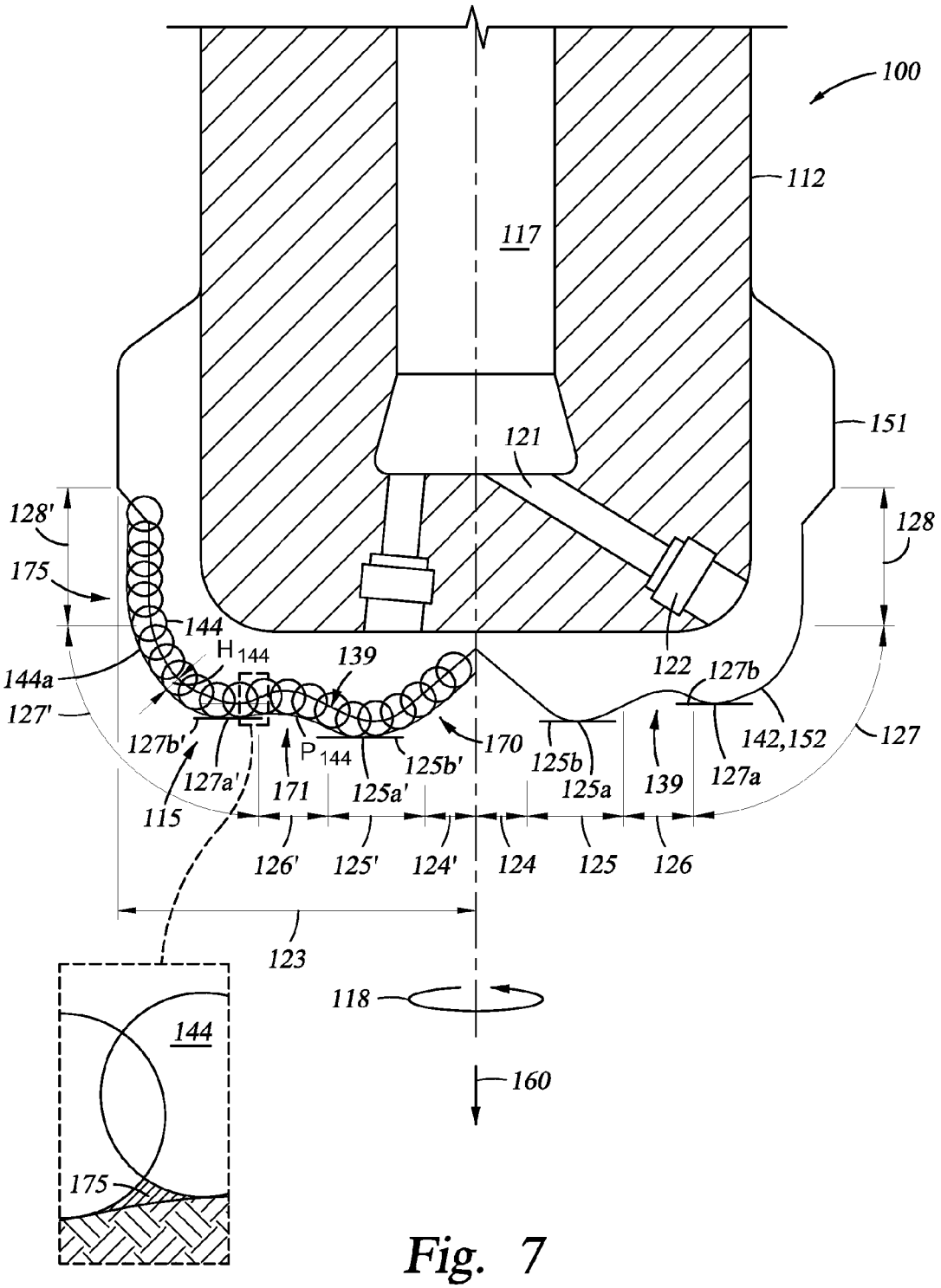
FIG. 7 is a partial cross-sectional view of the bit shown in FIG. 6 with the blades and the cutting faces of the cutter elements rotated into a single composite profile.

Referring now to FIG. 7, bit 100 is schematically shown with as it would appear with all primary blades 131, 132, 133, all secondary blades 134, 135, 136, and all cutting faces 144 rotated into a single composite rotated profile view. In rotated profile view, cutter-supporting surfaces 142, 152 of all blades 131-136 of bit 100 form and define a combined or composite blade profile 139 that extends radially from bit axis 111 to outer radius 123 of bit 100. In this embodiment, each cutter supporting surface 142, 152 of each primary blade 131, 132, 133 extends along and is coincident with composite blade profile 139, and each secondary blade 134, 135, 136 lies along composite blade profile 139.

Moving radially outward from bit axis 111, composite blade profile 139 (most clearly shown in the right half of bit 100 in FIG. 7) may generally be divided into five regions labeled cone or first concave region 124, first convex region 125, second concave region 126, shoulder or second convex region 127, and gage region 128. Cone region 124 comprises the radially innermost region of bit 100 and composite blade profile 139 extending generally from bit axis 111 to first convex region 125. In this embodiment, cone region 124 is generally concave or curved inward, and thus, is also referred to as first concave region 124. Radially adjacent cone region 124 is first convex region 125 having generally outwardly curved geometry. Adjacent first convex region 125 is second concave region 126 having an generally concave or curved inward geometry. Moving still further radially outward, adjacent second concave region 126 is shoulder region 127. In this embodiment, shoulder region 127 is generally convex or curved outward, and thus, is also referred to as second convex region 127. Next to shoulder region 127 is the gage region 128 which extends substantially parallel to bit axis 111 at the outer radial periphery of composite blade profile 139. Between bit axis 111 and gage region 128, composite blade profile 139 includes a plurality of alternating concave and convex regions—first concave region 124, first convex region 125, second concave region 126, and second convex region 127. A composite blade profile with such an arrangement may also be referred to herein as a "wavy" or "wave-shaped" composite blade profile. Unlike the composite blade profile of most conventional fixed cutter bits (e.g., composite blade profile 39 of bit 10 shown FIG. 3) that include only a single concave region (e.g., cone region 24 shown in FIG. 3), composite blade profile 139 of bit 100 includes a plurality of concave regions. In this particular embodiment, composite blade profile 139 includes two concave regions—cone region 124 and second concave region 126. As used herein, the term "concave" is used to describe a surface or profile in rotated profile view that is inwardly bowed or curved relative to the bit body, and thus, has a negative radius of curvature. Further, as used herein, the term "convex" is used to describe a surface or profile in rotated profile view that is outwardly bowed or curved relative to the bit body, and thus, has a positive radius of curvature.

Referring still to FIG. 7, the axially lowermost point of each convex region 125, 127 of composite blade profile 139 includes a first blade profile nose 125*a* and a second blade profile nose 127*a*, respectively. At each blade profile nose 125*a*, 127*a*, the slope of a tangent line 125*b*, 127*b* to composite blade profile 139 is zero in rotated profile view. Thus, unlike the composite blade profile of most conventional fixed cutter bits (e.g., composite blade profile 39 shown in FIG. 3), in this embodiment, composite blade profile 139 includes two blade profile noses—a first blade profile nose 125*a* and a second blade profile nose 127*a*.

Composite blade profile 139 is preferably continuously contoured. As used herein, the term "continuously contoured" may be used to describe surfaces and profiles that are smoothly and continuously curved so as to be free of sharp edges and/or transitions with radii less than 0.5 in. Thus, regions 124-128 of composite blade profile 139 are preferably smoothly curved and have radii of curvature greater than about 0.5 in. By eliminating small radii along blade profile 139, detrimental stresses in the surface of each blade forming blade profile 139 may be reduced, leading to relatively durable blades.

As previously described, the profile of bit 100 of FIG. 7 is shown as it would appear with all the blades 131-136 rotated into a single rotated profile. Thus, FIG. 7 represents the combined effect of the rotation of the cutter-supporting surfaces 142, 152 of each blade 131-136 of bit 100. However, it should be appreciated that each individual blade of bit 100 defines its own blade profile in rotated profile view that may be the same or different from the composite rotated profile of all the blades of bit 100. In this embodiment, each primary blade 131, 132, 133 has a blade profile in rotated profile view that is substantially the same as the composite rotated profile 139, and therefore, the cutter-supporting surface 142 of each primary blade 131, 132, 133 extends to and defines the composite blade profile 139. However, in general, the composite blade profile (e.g., composite blade profile 139) may be defined by the cutter-supporting surface of a single blade, or by the cutter-supporting surface of multiple blades. For instance, a single blade of the bit (e.g., bit 100) may have a cutter-supporting surface that extends to and defines the composite blade profile, while the cutter-supporting surfaces of the remaining blades do not extend to the composite blade profile (i.e., the cutter-supporting surfaces of the remaining blades are each offset from the composite blade profile). Further, in this embodiment, each secondary blade 133, 134, 135 extends to and defines a portion of the composite blade profile 139.

As shown in FIGS. 6 and 7, cutter elements 140 are arranged in rows along blades 131-136 and are positioned along the bit face 120 in the regions previously described as cone or first concave region 124, first convex region 125, second concave region 126, shoulder or second convex region 127, and gage region 128 of composite blade profile 139. In particular, cutter elements 140 are mounted on blades 131-136 in predetermined radially-spaced positions relative to the central axis 111 of the bit 100. In general, cutter elements 140 may be mounted in any suitable arrangement on blades 131-136. Examples of suitable arrangements may include, without limitation, radially extending rows, arrays or organized patterns, sinusoidal pattern, random, or combinations thereof.

Referring specifically to FIG. 7, each cutting face 144 extends to an extension height $H_{144}$ measured perpendicularly from cutter-supporting surface 142, 152 (or blade profile 139) to its outermost cutting tip 144*a*. In rotated profile view, the outermost cutting tips 144*a* of cutting faces 144 form and define an outermost composite outermost cutting profile $P_{144}$ that extends radially from bit axis 111 to outer radius 123. Specifically, a curve passing through the outermost cutting tips 144*a* contacting the formation in rotated profile view represents outermost composite cutting profile $P_{144}$. As shown in FIG. 7, each cutting face 144 has substantially the same extension height $H_{144}$, and thus, each cutting tip 144*a* extends to and contacts the formation in rotated profile view. However, in other embodiments, the cutting tips of one or more select cutter elements may not extend to and contact the formation in rotated profile view. Rather, the cutting tips of such cutter elements may be covered by the cutting face of one or more other cutter elements in rotated profile view. Cutting tips that are covered by the cutting faces of other cutter elements in rotated profile view do not extend to, and hence, do not define the outermost composite cutting profile. In FIG. 7, outermost composite cutting profile $P_{144}$ of bit 100 is best seen on the left half of the rotated profile.

In this embodiment, each cutting face 144 has substantially the same extension height $H_{144}$, and thus, outermost composite cutting profile $P_{144}$ is substantially parallel with composite blade profile 139. However, in other embodiments, one or more cutting faces (e.g., cutting faces 144) may have different extension heights and/or the outermost composite cutting profile (e.g., outermost composite cutting profile $P_{144}$) may not be parallel with the composite blade profile (e.g., composite blade profile 139).

Similar to composite blade profile 139, outermost composite cutting profile $P_{144}$ may also be divided into five regions labeled cone or first concave region 124', first convex region 125', second concave region 126', shoulder or second convex region 127', and gage region 128'. Analogous to regions 124, 125, 126, 127 of composite blade profile 139, regions 124', 125', 126', 127' of outermost cutting profile $P_{144}$ are generally concave, convex, concave, and convex, respectively. In this embodiment, regions 124', 125', 126', 127' of outermost composite cutting profile $P_{144}$ generally correspond to and substantially overlap with regions 124, 125, 126, 127, 128 of composite blade profile 139. Unlike the outermost composite cutting profile of most conventional fixed cutter bits (e.g., outermost composite cutting profile $P_{44}$ of bit 10 shown FIG. 3) that include only a single concave region (e.g., cone region 24 shown in FIG. 3), outermost composite cutting profile $P_{144}$ of bit 100 includes a plurality of concave regions. In this particular embodiment, outermost composite cutting profile $P_{144}$ includes two concave regions—cone region 124' and second concave region 126'.

The axially lowermost point of first convex region 125', and shoulder or second convex region 127' of outermost composite cutting profile $P_{144}$ define a first cutting profile nose 125*a*' and a second cutting profile nose 127*a*', respectively. At each cutting profile nose 125*a*', 127*a*', the slope of a tangent line 125*b*', 127*b*', respectively, to convex regions 125', 127', respectively, and outermost composite cutting profile $P_{144}$ is zero. Unlike the outermost composite cutting profile of most conventional fixed cutter bits (e.g., outermost composite cutting profile $P_{44}$ shown in FIG. 3), in this embodiment, outermost composite cutting profile $P_{144}$ includes two cutting profile noses—a first cutting profile nose 125*a*' and a second cutting profile nose 127*a'*.

Outermost composite cutting profile $P_{144}$ is also preferably continuously contoured. Thus, regions 124'-128' of outermost composite cutting profile $P_{144}$ are preferably smoothly curved and have radii of curvature greater than about 0.5 in.

Referring still to FIG. 7, in this embodiment, gage pads 151 extend from each blade as previously described and define the outer radius 123 of bit 100. Outer radius 123 extends to and therefore defines the full gage diameter of bit 100. In addition, body 112 includes a central longitudinal bore 117 permitting drilling fluid to flow from the drill string into bit 100. Body 112 is also provided with downwardly extending flow passages 121 having ports or nozzles 122 disposed at their lowermost ends. The flow passages 121 are in fluid communication with central bore 117. Together, passages 121 and nozzles 122 serve to distribute drilling fluids around a cutting structure 115 to flush away formation cuttings during drilling and to remove heat from bit 100.

As shown in FIG. 7, cutter elements 140 are arranged on the plurality of blades in each region 124-128 of composite blade profile 139, and their corresponding cutting tips 144*a* form outermost cutting profile $P_{144}$ having analogous regions 124'-128'. Cutter elements 140 are sized and radially spaced such that adjacent cutting faces 144 partially overlap in rotated profile view, thereby forming a ridge or kerf 175 of uncut formation therebetween as bit 100 is rotated. On a micro-level, ridges 175 of uncut formation between adjacent cutting faces 144 restrict the lateral and radial movement of bit 100 in a direction generally perpendicular to bit axis 111, thereby tending to enhance the stability of bit 100.

Moreover, the generally wave-shaped composite blade profile 139 and wave-shaped outermost composite cutting profile $P_{44}$ including first concave regions 124, 124', respectively, result in the formation of a central peak or core 170 of uncut formation on the borehole bottom that extends axially into cone regions 124, 124' as bit 100 is rotated and cutting faces 144 engage the formation. On a macro-level, core 170 of uncut formation restricts the lateral and radial movement of bit 100 generally perpendicular to bit axis 111, thereby tending to enhance the stability of bit 100. Likewise, second concave regions 126, 126' of composite blade profile 139 and outermost composite cutting profile $P_{144}$, respectively, result in the formation of an annular ring or bolus 171 of uncut formation that extends axially into second concave regions 126, 126'. On a macro-level, annular ring 171 of uncut formation also restricts the lateral and radial movement of bit 100 generally perpendicular to bit axis 111, thereby tending to further enhance the stability of bit 100.

As previously described, in most conventional bits, kerfs or ridges of uncut formation between adjacent cutting faces provides a stability enhancing feature on the micro-level, and the core of uncut formation extending axially into the concave cone region of the bit provides a stability enhancing feature on the macro-level. However, embodiments of bit 100 include an additional stability enhancing feature. On a micro level, bit 100 forms kerfs or ridges of uncut formation between adjacent cutting faces 144 that provide a stability enhancing feature, and on macro-level, core 170 of uncut formation extending axially into cone regions 124, 124' provides a stability enhancing feature. In addition, annular ring 171 of uncut formation extending axially into second concave regions 126, 126' provides yet another stability enhancing feature on the macro-level. Consequently, embodiments of bit 100 offer the potential for improved stability as compared to most conventional fixed cutter bits.

Figure 8:
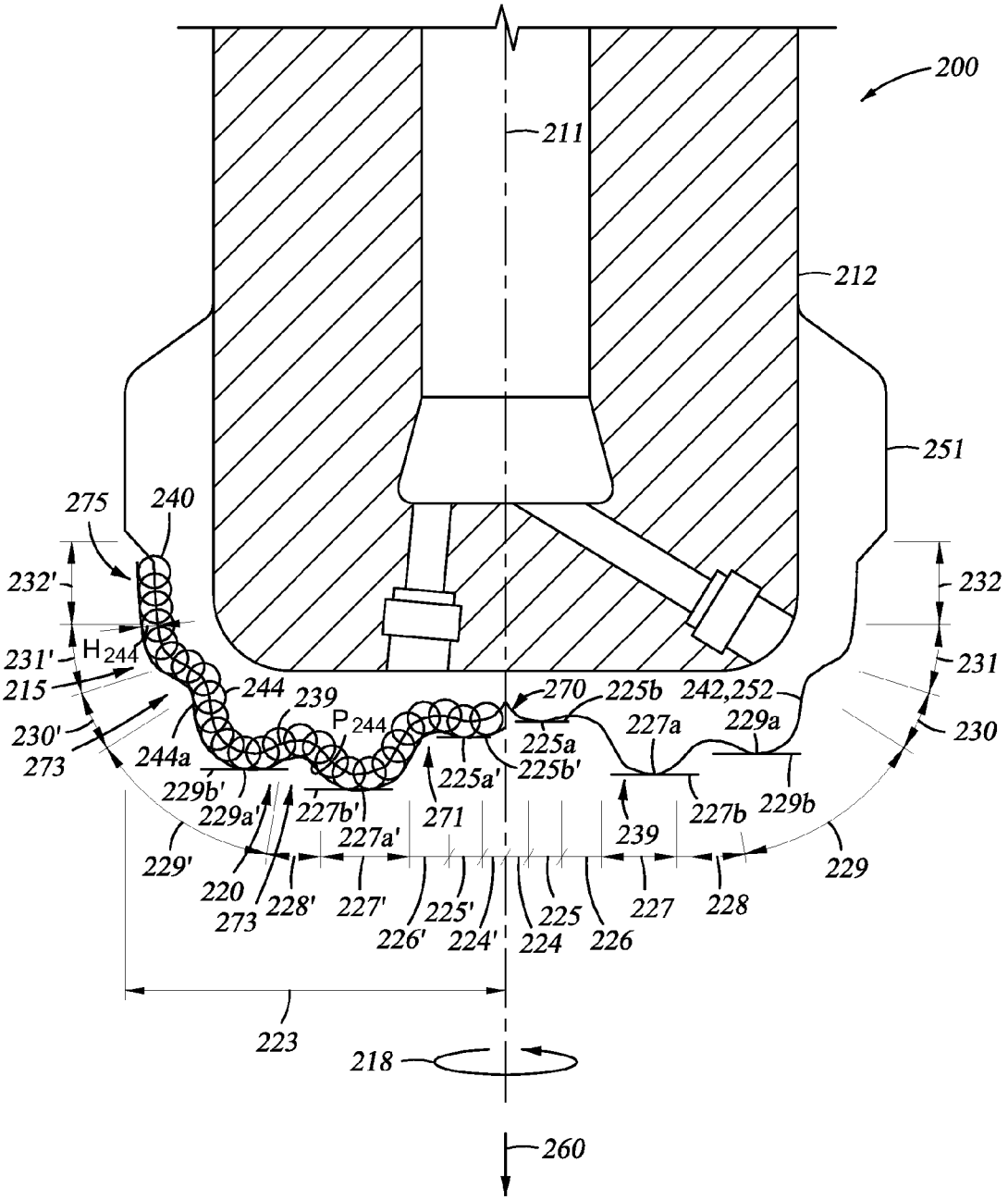
FIG. 8 is a partial cross-sectional view of an embodiment of a bit made in accordance with the principles described herein with the blades and the cutting faces of the cutter elements rotated into a single composite profile.

Referring now to FIG. 8, a rotated profile view of another embodiment of a bit 200 constructed in accordance with the principles described herein is shown. Bit 200 is a fixed cutter or drag bit, and is preferably a PD bit adapted for drilling through formations of rock to form a borehole. Bit 200 comprises a bit body 212 having a bit face 220 that supports a cutting structure 215. Bit 200 further includes a central axis 211 about which bit 200 rotates in a cutting direction represented by arrow 218.

Similar to bit 100 and cutting structure 115 previously described, cutting structure 215 of bit 200 includes a plurality of primary blades and a plurality of secondary blades which extend generally radially along bit face 220. Each primary and secondary blade includes a cutter-supporting surface 242, 252 for mounting a plurality of cutter elements 240, each having a forward-facing cutting face 244 with an outermost cutting tip 244*a* furthest from the cutter-supporting surface 242, 252 to which it is mounted. Bit 200 further includes gage pads 251 disposed about the circumference of bit 200 at angularly spaced locations. Gage pads 251 extend from each blade as previously described and define the outer radius 223 of bit 200. Outer radius 223 extends to and therefore defines the full gage diameter of bit 200.

In FIG. 8, bit 200 is schematically shown with as it would appear with all primary blades, all secondary blades, and all cutting faces 244 rotated into a single composite rotated profile view. In rotated profile view, cutter-supporting surfaces 242, 252 of all blades of bit 200 form and define a combined or composite blade profile 239 that extends radially from bit axis 211 to outer radius 223 of bit 100. In this embodiment, each cutter supporting surface 242, 252 of each primary blade extends along and is coincident with composite blade profile 239, and each secondary blade lies along composite blade profile 239.

Moving radially outward from bit axis 211, composite blade profile 239 (most clearly shown in the right half of bit 200 in FIG. 8) may generally be divided into nine regions labeled cone or first concave region 224, first convex region 225, second concave region 226, second convex region 227, third concave region 228, third convex region 229, fourth concave region 230, shoulder or fourth convex region 231, and gage region 232. Cone region 224 comprises the radially innermost region of bit 200 and composite blade profile 239 extending generally from bit axis 211 to first convex region 225. In this embodiment, cone region 224 is curved inward, and thus, is also referred to as first concave region 224. Adjacent cone region 224 is first convex region 225 having generally outwardly curved geometry. Adjacent first convex region 225 is second concave region 226 having an inwardly curved geometry. Moving still further radially outward, adjacent second concave region 226 is second convex region 227, followed by third concave region 228, third convex region 229, fourth concave region 230, and shoulder region 231. In this embodiment, shoulder region 231 is generally convex or curved outward, and thus, is also referred to as fourth convex region 231. Next to shoulder region 231 is the gage region 232 which extends substantially parallel to bit axis 211 at the outer radial periphery of composite blade profile 239. Between bit axis 211 and gage region 232, composite blade profile 239 includes a plurality of alternating concave and convex regions, and thus, may also be referred to as a wave-shaped profile. Unlike the composite blade profile of most conventional fixed cutter bits (e.g., composite blade profile 39 of bit 10 shown FIG. 3) that include only a single concave region (e.g., cone region 24 shown in FIG. 3), composite blade profile 239 of bit 200 includes a plurality of concave regions. In this particular embodiment, composite blade profile 239 includes four concave regions—cone or first concave region 224, second concave region 226, third concave region 228, and fourth concave region 230.

Referring still to FIG. 8, the axially lowermost point of each convex region 225, 227, 229 of composite blade profile 239 includes a first blade profile nose 225*a*, a second blade profile nose 227*a*, and a third blade profile nose 229*a*, respectively. At each blade profile nose 225*a*, 227*a*, 229*a* the slope of a tangent line 225*b*, 227*b*, 229*b* to composite blade profile 239 is zero in rotated profile view. Thus, unlike the composite blade profile of most conventional fixed cutter bits (e.g., composite blade profile 39 shown in FIG. 3), in this embodiment, composite blade profile 239 includes three blade profile noses—a first blade profile nose 225*a*, a second blade profile nose 227*a*, and a third blade profile nose 229*a*. Although shoulder region 231 is convex in this embodiment, no points along shoulder region 231 of composite blade profile 239 have a slope of zero, and thus, shoulder region 231 does not include a blade profile nose.

Composite blade profile 239 is preferably continuously contoured such that is free of sharp edges and/or transitions with radii less than 0.5 in. Thus, regions 224-232 of composite blade profile 239 are preferably smoothly curved and have radii of curvature greater than about 0.5 in.

As previously described, the profile of bit 200 of FIG. 8 is shown as it would appear with all the blades rotated into a single rotated profile. Thus, FIG. 8 represents the combined effect of the rotation of the cutter-supporting surfaces 242, 252 of each blade of bit 200. However, it should be appreciated that each individual blade of bit 200 defines its own blade profile in rotated profile view that may be the same or different from the composite rotated profile of all the blades of bit 200.

Referring still to FIG. 8, cutter elements 240 are arranged on the cutter-supporting surfaces 242, 252 of the blades of bit 200 in the regions previously described as cone or first concave region 224, first convex region 225, second concave region 226, second convex region 227, third concave region 228, third convex region 229, fourth concave region 230, shoulder or fourth convex region 231, and gage region 232 of composite blade profile 239.

Each cutting face 244 extends to an extension height $H_{244}$ measured perpendicularly from cutter-supporting surface 242, 252 (or blade profile 239) to its outermost cutting tip 244*a*. In rotated profile view, the outermost cutting tips 244*a* of cutting faces 244 form and define an outermost composite outermost cutting profile $P_{244}$ that extends radially from bit axis 211 to outer radius 223. Specifically, a curve passing through the outermost cutting tips 244*a* contacting the formation in rotated profile view represents outermost composite cutting profile $P_{244}$. As shown in FIG. 8, in this embodiment, each cutting face 244 has substantially the same extension height $H_{244}$, and thus, outermost composite cutting profile $P_{244}$ is substantially parallel with composite blade profile 239. Further, in this embodiment, no cutting tip 244*a* is covered by cutting face 244 of another cutter element 240, and thus, each cutting tip 244*a* is included in outermost composite cutting profile $P_{244}$. In FIG. 8, outermost composite cutting profile $P_{244}$ of bit 200 is best seen on the left half of the rotated profile.

Similar to composite blade profile 239, outermost composite cutting profile $P_{244}$ may also be divided into nine regions labeled cone or first concave region 224', first convex region 225', second concave region 226', second convex region 227', third concave region 228', third convex region 229', fourth concave region 230', shoulder or fourth convex region 231', and gage region 232'. Analogous to regions 224, 225, 226, 227, 228, 229, 230, 231 of composite blade profile 239, regions 224', 225', 226', 227', 228', 229', 230', 231' of outermost cutting profile $P_{244}$ are generally concave, convex, concave, convex, concave, convex, concave, convex, respectively. In this embodiment, regions 224', 225', 226', 227', 228', 229', 230', 231' of outermost composite cutting profile $P_{244}$ generally correspond to and substantially overlap with regions 224, 225, 226, 227, 228, 229, 230, 231 of composite blade profile 239. Unlike the outermost composite cutting profile of most conventional fixed cutter bits (e.g., outermost composite cutting profile $P_{44}$ of bit 10 shown FIG. 3) that include only a single concave region (e.g., cone region 24 shown in FIG. 3), outermost composite cutting profile $P_{244}$ of bit 200 includes a plurality of concave regions. In this particular embodiment, outermost composite cutting profile $P_{244}$ includes four concave regions—first concave region 224', second concave region 226', third concave region 228', and fourth concave region 230'.

The axially lowermost point of first convex region 225', second convex region 227', and third convex region 229' of outermost composite cutting profile $P_{244}$ define a first cutting profile nose 225*a'*, a second cutting profile nose 227*a'*, and a third cutting profile nose 229*a'*, respectively. At each cutting profile nose 225*a'*, 227*a'*, 229*a'*, the slope of a tangent line 225*b'*, 227*b'*, 229*b'*, respectively, to convex regions 225', 227', 229', respectively, and outermost composite cutting profile $P_{244}$ is zero. Unlike the outermost composite cutting profile of most conventional fixed cutter bits (e.g., outermost composite cutting profile $P_{44}$ shown in FIG. 3), in this embodiment, outermost composite cutting profile $P_{244}$ includes three cutting profile noses—a first cutting profile nose 225*a'*, a second cutting profile nose 227*a'*, and a third cutting profile nose 229*a'*.

Outermost composite cutting profile $P_{244}$ is also preferably continuously contoured. Thus, regions 224'-232' of outermost composite cutting profile $P_{244}$ are preferably smoothly curved and have radii of curvature greater than about 0.5 in.

As shown in FIG. 8, cutter elements 240 are arranged on the plurality of blades in each region 224-232 of composite blade profile 239, and their corresponding cutting tips 244*a* form outermost cutting profile $P_{244}$ having analogous regions 224'-232'. Cutter elements 240 are sized and radially spaced such that adjacent cutting faces 244 partially overlap in rotated profile view, thereby forming a ridge or kerf 275 of uncut formation therebetween as bit 200 is rotated. On a micro-level, ridges 275 of uncut formation between adjacent cutting faces 244 restrict the lateral and radial movement of bit 200 in a direction generally perpendicular to bit axis 211, thereby tending to enhance the stability of bit 200.

Moreover, the generally wave-shaped composite blade profile 239 and wave-shaped outermost composite cutting profile $P_{244}$ including first concave regions 224, 224', respectively, result in the formation of a central peak or core 270 of uncut formation on the borehole bottom that extends axially into cone regions 224, 224' as bit 200 is rotated and cutting faces 244 engage the formation. In addition, second concave regions 226, 226', third concave regions 228, 228', and fourth concave regions 230, 230' of composite blade profile 239 and outermost composite cutting profile $P_{244}$, respectively, result in the formation of annular rings 271, 272, 273 of uncut formation extending axially into region 226, 226', 228, 228', 230, 230', respectively. On a macro-level, core 270 and annular rings 271, 272, 273 of uncut formation restricts the lateral and radial movement of bit 200 generally perpendicular to bit axis 211, thereby tending to enhance the stability of bit 200. As previously described, in most conventional bits, kerfs or ridges of uncut formation between adjacent cutting faces provides a stability enhancing feature on the micro-level, and the core of uncut formation extending axially into the concave cone region of the bit provides a stability enhancing feature on the macro-level. However, embodiments of bit 200 include additional stability enhancing features, namely, on a micro level, bit 200 forms kerfs or ridges 275 of uncut formation between adjacent cutting faces 244 that provide a stability enhancing feature, and on macro-level, core 270 of uncut formation extending axially into cone region 224 provides a stability enhancing feature. In addition, annular rings 271, 272, 273 of uncut formation extending axially into region 226, 226', 228, 228', 230, 230', respectively, provide yet additional stability enhancing features on the macro-level. Consequently, embodiments of bit 200 offer the potential for improved stability as compared to most conventional fixed cutter bits.

Figure 9:
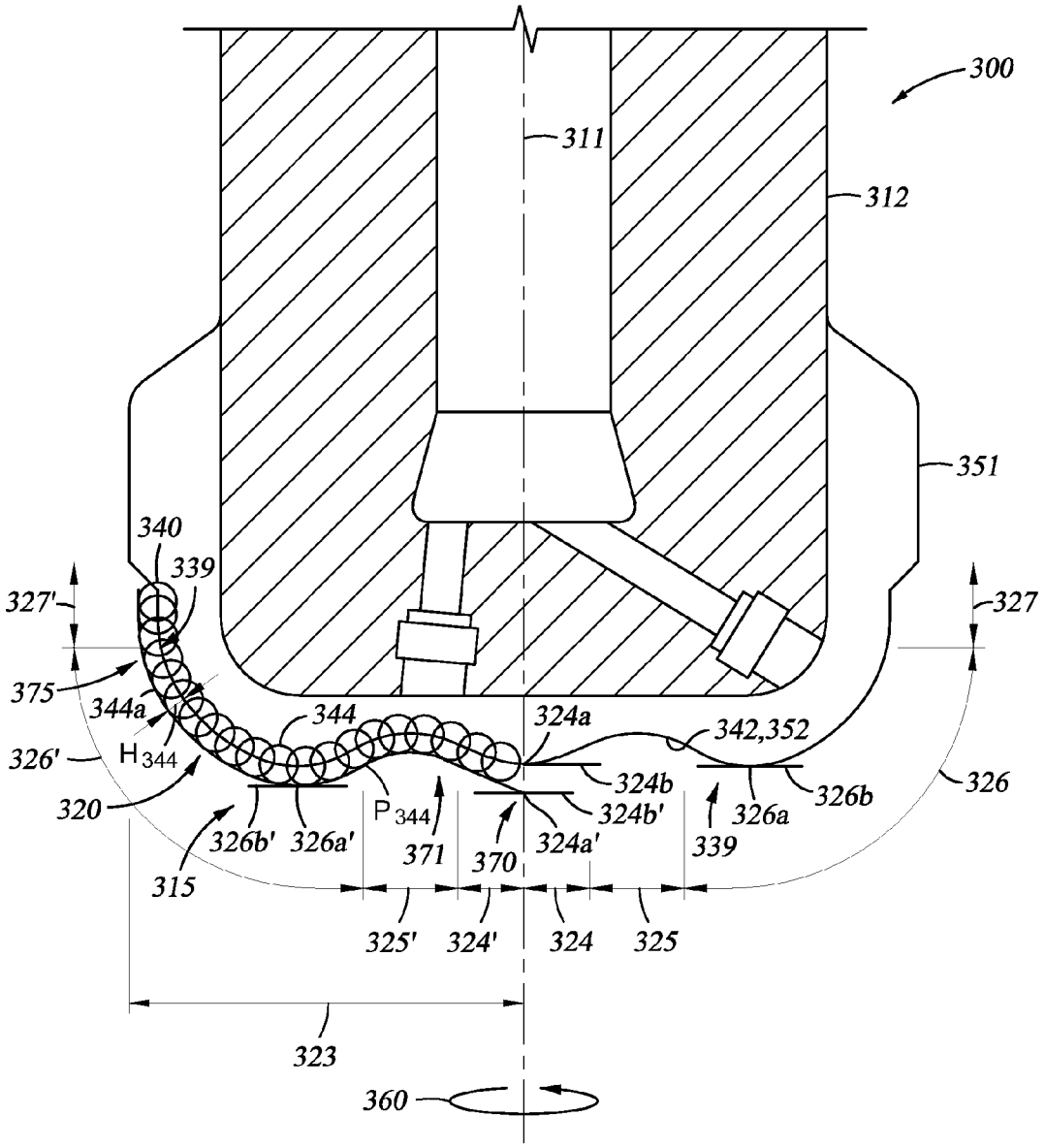
FIG. 9 is a partial cross-sectional view of an embodiment of a bit made in accordance with the principles described herein with the blades and the cutting faces of the cutter elements rotated into a single composite profile.

Referring now to FIG. 9, a rotated profile view of another embodiment of a bit 300 constructed in accordance with the principles described herein is shown. Bit 300 is a fixed cutter or drag bit, and is preferably a PD bit adapted for drilling through formations of rock to form a borehole. Bit 300 comprises a bit body 312 having a bit face 320 that supports a cutting structure 315. Bit 300 further includes a central axis 311 about which bit 300 rotates in a cutting direction represented by arrow 318.

Similar to bit 100 and cutting structure 115 previously described, cutting structure 315 of bit 300 includes a plurality of primary blades and a plurality of secondary blades which extend generally radially along bit face 320. Each primary and secondary blade includes a cutter-supporting surface 342, 352, respectively, for mounting a plurality of cutter elements 340, each having a forward-facing cutting face 344 with an outermost cutting tip 344*a* furthest from the cutter-supporting surface 342, 352 to which it is mounted. Bit 300 further includes gage pads 351 disposed about the circumference of bit 300 at angularly spaced locations. Gage pads 351 extend from each blade as previously described and define the outer radius 323 of bit 300. Outer radius 323 extends to and therefore defines the full gage diameter of bit 300.

In FIG. 9, bit 300 is schematically shown with as it would appear with all primary blades, all secondary blades, and all cutting faces 344 rotated into a single composite rotated profile view. In rotated profile view, cutter-supporting surfaces 342, 352 of all blades of bit 300 form and define a combined or composite blade profile 339 that extends radially from bit axis 311 to outer radius 323 of bit 100.

Moving radially outward from bit axis 311, composite blade profile 339 (most clearly shown in the right half of bit 300 in FIG. 9) may generally be divided into four regions labeled first convex region 324, first concave region 325, shoulder or second convex region 326, and gage region 327. First convex region 324 comprises the radially innermost region of bit 300 and composite blade profile 339 extending generally from bit axis 311 to first concave region 225. Adjacent first convex region 324 is first concave region 325 having generally inwardly curved geometry. Adjacent first concave region 325 is second convex region 326 having a generally convex or curved outward geometry. Next to second convex region or shoulder 326 is the gage region 327 which extends substantially parallel to bit axis 311 at the outer radial periphery of composite blade profile 339. Between bit axis 311 and gage region 327, composite blade profile 339 includes a plurality of alternating concave and convex regions, and thus, may also be referred to as a wave-shaped profile. Thus, composite blade profile 339 of this embodiment includes a single concave region—first concave region 324.

Referring still to FIG. 9, the axially lowermost point of each convex region 324, 326 of composite blade profile 339 includes a first blade profile nose 324*a* and a second blade profile nose 326*a*, respectively. At each blade profile nose 324*a*, 326*a* the slope of a tangent line 324*b*, 326*b* to composite blade profile 339 is zero in rotated profile view. Thus, unlike the composite blade profile of most conventional fixed cutter bits (e.g., composite blade profile 39 shown in FIG. 3), in this embodiment, composite blade profile 339 includes two blade profile noses—a first blade profile nose 324*a* and a second blade profile nose 326*a*. As shown in FIG. 9, first blade profile nose 324*a* is at the radial center of bit body 312 and is intersected by bit axis 311.

Composite blade profile 339 is preferably continuously contoured such that is free of sharp edges and/or transitions with radii less than 0.5 in. Thus, regions 324-327 of composite blade profile 339 are preferably smoothly curved and have radii of curvature greater than about 0.5 in.

Referring still to FIG. 9, cutter elements 340 are arranged on the cutter-supporting surfaces 342, 352 of the blades of bit 300 in the regions previously described as first convex region 324, first concave region 325, shoulder or second convex region 326, and gage region 327 of composite blade profile 239. Each cutting face 344 extends to an extension height $H_{344}$ measured perpendicularly from cutter-supporting surface 342, 352 (or blade profile 339) to its outermost cutting tip 344*a*. In rotated profile view, the outermost cutting tips 344*a* of cutting faces 344 form and define an outermost composite outermost cutting profile $P_{344}$ that extends radially from bit axis 311 to outer radius 323. Specifically, a curve passing through the outermost cutting tips 344*a* contacting the formation in rotated profile view represents outermost composite cutting profile $P_{344}$. As shown in FIG. 9, in this embodiment, each cutting face 344 has substantially the same extension height $H_{344}$, and thus, outermost composite cutting profile $P_{344}$ is substantially parallel with composite blade profile 339. Further, in this embodiment, no cutting tip 344*a* is covered by cutting face 344 of another cutter element 340, and thus, each cutting tip 344*a* is included in outermost composite cutting profile $P_{344}$. In FIG. 9, outermost composite cutting profile $P_{344}$ of bit 300 is best seen on the left half of the rotated profile.

Similar to composite blade profile 339, outermost composite cutting profile $P_{344}$ may also be divided into four regions labeled first convex region 324', first concave region 325', shoulder or second convex region 326', and gage region 327'. Analogous to regions 324, 325, 326 of composite blade profile 339, regions 324', 325', 326' of outermost cutting profile $P_{344}$ are generally convex, concave, convex, respectively. In this embodiment, regions 324', 325', 326', 327' of outermost composite cutting profile $P_{344}$ generally correspond to and substantially overlap with regions 324, 325, 326, 327 of composite blade profile 339. In this particular embodiment, outermost composite cutting profile $P_{344}$ includes one concave regions—first concave region 325'.

The axially lowermost point of first convex region 324', second convex region 326' of outermost composite cutting profile $P_{344}$ define a first cutting profile nose 324*a*', a second cutting profile nose 326*a*', respectively. At each cutting profile nose 324*a*', 326*a*', the slope of a tangent line 324*b*', 326*b*', respectively, to convex regions 324', 326', respectively, and outermost composite cutting profile $P_{344}$ is zero. Unlike the outermost composite cutting profile of most conventional fixed cutter bits (e.g., outermost composite cutting profile $P_{44}$ shown in FIG. 3), in this embodiment, outermost composite cutting profile $P_{344}$ includes two cutting profile noses—a first cutting profile nose 324*a*', and a second cutting profile nose 326*a*'. As shown in FIG. 9, first cutting profile nose 324*a*' is at the radial center of bit body 312 and is intersected by bit axis 311.

Outermost composite cutting profile $P_{344}$ is also preferably continuously contoured. Thus, regions 324'-327' of outermost composite cutting profile $P_{344}$ are preferably smoothly curved and have radii of curvature greater than about 0.5 in.

Referring still to FIG. 9, cutter elements 340 are arranged on the plurality of blades in each region 324-327 of composite blade profile 339, and their corresponding cutting tips 344*a* form outermost cutting profile $P_{344}$ having analogous regions 324'-327'. Cutter elements 340 are sized and radially spaced such that adjacent cutting faces 244 partially overlap in rotated profile view, thereby forming a ridge or kerf 375 of uncut formation therebetween as bit 300 is rotated. On a micro-level, ridges 375 of uncut formation between adjacent cutting faces 344 restrict the lateral and radial movement of bit 300 in a direction generally perpendicular to bit axis 311, thereby tending to enhance the stability of bit 300.

The generally wave-shaped composite blade profile 339 and wave-shaped outermost composite cutting profile $P_{344}$ including first convex regions 324, 324', respectively, result in the formation of a central pilot 370 that penetrates axially into the formation under WOB as bit 300 is rotated and cutting faces 344 engage the formation. Moreover, the generally wave-shaped composite blade profile 339 and wave-shaped outermost composite cutting profile $P_{344}$ including first concave regions 325, 325', respectively, result in the formation of an annular ring 371 of uncut formation on the borehole bottom that extends axially into concave regions 325, 325' as bit 300 is rotated and cutting faces 344 engage the formation. On a macro-level, pilot 370 extending into the formation and ring 371 of uncut formation restrict the lateral and radial movement of bit 300 generally perpendicular to bit axis 311, thereby tending to enhance the stability of bit 300. As previously described, in most conventional bits, kerfs or ridges of uncut formation between adjacent cutting faces provides a stability enhancing feature on the micro-level, and the core of uncut formation extending axially into the concave cone region of the bit provides a stability enhancing feature on the macro-level. However, embodiments of bit 300 include additional stability enhancing features, namely, on a micro level, bit 300 forms kerfs or ridges 375 of uncut formation between adjacent cutting faces 344 that provide a stability enhancing feature, and on macro-level, pilot 370 of extending axially into the formation provides a stability enhancing feature. In addition, annular ring 371 of uncut formation extending axially into region 325 provides yet additional stability enhancing features on the macro-level. Consequently, embodiments of bit 300 offer the potential for improved stability as compared to most conventional fixed cutter bits.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A drill bit for drilling a borehole in earthen formation, the bit comprising:

a bit body having a bit axis and a bit face;

a plurality of primary blades, each primary blade extending radially along the bit face, each primary blade includes a cutter-supporting surface, the cutter-supporting surface of one or more of the primary blades defines a composite blade profile in rotated profile view extending from proximate the bit axis to an outer radius of the bit body; and a plurality of cutter elements mounted to the cutter-supporting surface of the plurality of primary blades, wherein:

each cutter element has a forward-facing cutting face with a cutting edge adapted to penetrate and shear the earthen formation;

the cutting faces of the plurality of cutter elements define a composite outermost cutting profile in rotated profile view that extends radially from a first end proximate the bit axis to a second end at the radially outermost gage region;

at least a portion of the composite outermost cutting profile extends an axial distance beyond the composite blade profile;

the composite outermost cutting profile includes at least one concave region radially offset from the bit axis;

the cutting face of each cutter element defining the composite outermost cutting profile disposed between the cutter element at the first end and the cutter element at the second end of the composite outermost cutting profile partially overlaps with the cutting faces of two adjacent cutter elements in rotated profile view.

2. The drill bit of clam 1, wherein the outermost composite cutting profile is continuously contoured.

3. The drill bit of claim 1, wherein the outermost composite cutting profile comprises a plurality of concave regions.

4. The drill bit of claim 1, wherein one or more cutting faces defining the composite outermost cutting profile have different extension heights.

5. The drill bit of claim 4, wherein at least one of the plurality of primary blades further comprises a depth-of-cut limiter.

6. The drill bit of claim 1, wherein at least one of the plurality of primary blades further comprises a depth-of-cut limiter.

7. The drill bit of claim 1, wherein the outermost cutting profile is substantially parallel to the composite blade profile.

8. The drill bit of claim 1, wherein at least a portion of the outermost cutting profile is non-parallel to the composite blade profile.

9. The drill bit of claim 1, wherein the composite outermost cutting profile includes a plurality of convex regions, one of the convex regions being disposed between concave regions.

10. The drill bit of claim 1 further comprising:

a plurality of secondary blades extending radially along the bit face, each secondary blade including a cutter-supporting surface;

a plurality of cutter elements mounted to the cutter-supporting surface of the secondary blades, wherein each cutter element on each secondary blade has a forward-facing cutting face with a cutting edge adapted to penetrate and shear the earthen formation.

11. A method for forming a borehole in earthen formation comprising:

mounting a drill bit on the lower end of a drill string, the bit comprising:

a bit body having a bit axis and a bit face;

a plurality of primary blades, each primary blade extending radially along the bit face, each primary blade includes a cutter-supporting surface, the cutter-supporting surface of one or more of the primary blades defines a composite blade profile in rotated profile view extending from proximate the bit axis to an outer radius of the bit body; and a plurality of cutter elements mounted to the cutter-supporting surface of the plurality of primary blades, wherein:

each cutter element has a forward-facing cutting face with a cutting edge adapted to penetrate and shear the earthen formation;

the cutting faces of the plurality of cutter elements define a composite outermost cutting profile in rotated profile view that extends radially from a first end proximate the bit axis to a second end at the radially outermost gage region;

at least a portion of the composite outermost cutting profile extends an axial distance beyond the composite blade profile;

the composite outermost cutting profile includes at least one concave region radially offset from the bit axis; and the cutting face of each cutter element defining the composite outermost cutting profile disposed between the cutter element at the first end and the cutter element at the second end of the composite outermost cutting profile partially overlaps with the cutting faces of two adjacent cutter elements in rotated profile view; and rotating the drill bit to form the borehole in the earthen formation.

12. The method of claim 11, wherein the outermost composite cutting profile is continuously contoured.

13. The method of claim 11, wherein the outermost composite cutting profile comprises a plurality of concave regions.

14. The method of claim 11, wherein one or more cutting faces defining the composite outermost cutting profile have different extension heights.

15. The method of claim 14, wherein at least one of the plurality of primary blades further comprises a depth-of-cut limiter.

16. The method of claim 11, wherein at least one of the plurality of primary blades further comprises a depth-of-cut limiter.

17. The method of claim 11, wherein the outermost cutting profile is substantially parallel to the composite blade profile.

18. The method of claim 11, wherein at least a portion of the outermost cutting profile is non-parallel to the composite blade profile.

19. The method of claim 11, wherein the composite outermost cutting profile includes a plurality of convex regions, one of the convex regions being disposed between concave regions.

20. The method of claim 11 further comprising:

a plurality of secondary blades extending radially along the bit face, each secondary blade including a cutter-supporting surface;

a plurality of cutter elements mounted to the cutter-supporting surface of the secondary blades, wherein each cutter element on each secondary blade has a forward-facing cutting face with a cutting edge adapted to penetrate and shear the earthen formation.

* * * * *